US007091408B2

(12) United States Patent
Thibodeau

(10) Patent No.: US 7,091,408 B2
(45) Date of Patent: Aug. 15, 2006

(54) JRT HARMONICA HOLDER

(75) Inventor: Jerry Real Thibodeau, 1817 Old Beach Rd., St. Augustine, FL (US) 32080

(73) Assignee: Jerry Real Thibodeau, St Augustine, FL (US)

( * ) Notice: Subject to any disclaimer, the term of this patent is extended or adjusted under 35 U.S.C. 154(b) by 0 days.

(21) Appl. No.: 10/984,682

(22) Filed: Nov. 9, 2004

(65) Prior Publication Data

US 2006/0096441 A1 May 11, 2006

(51) Int. Cl.
*G10D 7/12* (2006.01)

(52) U.S. Cl. ..... 84/377
(58) Field of Classification Search ..... 84/379; 248/443, 444
See application file for complete search history.

(56) References Cited

U.S. PATENT DOCUMENTS

| | | | | | |
|---|---|---|---|---|---|
| 4,397,213 | A * | 8/1983 | Hubbard | ..... | 84/453 |
| 4,402,249 | A * | 9/1983 | Zankman | ..... | 84/453 |
| 4,739,686 | A * | 4/1988 | Doll | ..... | 84/379 |
| 5,635,656 | A * | 6/1997 | Bowden | ..... | 84/379 |

* cited by examiner

*Primary Examiner*—Kimberly Lockett

(57) ABSTRACT

The JRT Harmonica Holder is a hands-free device for playing the harmonica and is made to fit in any typical microphone holder that is attached to a microphone stand. There are no springs, clamps, bolts or screws involved in order to install the JRT Harmonica Holder. The JRT Harmonica Holder is made out of poly vinyl chloride (pvc) and chlorinated poly vinyl chloride (cpvc) and is completely electrically shock proof. The JRT Harmonica Holder is 1 inch in width and makes it easy and clean to install other key harmonicas in seconds. Its design purpose is to enable a person to play more than one instrument at a time. A support plate for the microphone stand pedestal is designed to stabilize any backward motion which is a typical problem when a microphone stand is used for this purpose.

3 Claims, 3 Drawing Sheets

12

23
32
10
13
26
16
31
14
29
15
24

JRT HARMONICA HOLDER

CROSS-REFERENCES TO RELATED APPLICATION

| | | |
|---|---|---|
| 4,212,219 | July 1980 | Hubbard |
| 4,541,321 | September 1985 | Miner |
| 4,397,213 | August 1983 | Hubbard |
| 5,619,001 | April 1997 | Pasin |
| 4,545,277 | October 1985 | Strand |

STATEMENT REGARDING FEDERALLY SPONSORED DEVELOPMENT

Not Applicable

FIELD OF INVENTION

Musical Related

The JRT Harmonica Holder invention is a new holding device for the music instrument called the harmonica or mouth harp, an instrument played by breathing in and out or blowing and sucking out of a person's mouth over metal reeds which create a sound. The harmonica is a hand held instrument.

The JRT Harmonica Holder invention eliminates the use of hands in order to play the harmonica with out any device connected to a person playing the harmonica instrument.

My personal research endeavor into a similar harmonica holder involves a period of 34 years of playing the harmonica instrument and seeking out a device such as mine in music stores, instrument catalogs, and specifically a magazine that specializes in harmonica instruments, such as Kevin's Harps, 210 Farnsworth Avenue, Bordentown, N.J., 08505.

BACKGROUND —DESCRIPTION OF PRIOR ART

There have been a few inventions with the best of intentions to solve the hands free harmonica holder attached to a microphone stand like U.S. Pat. No. (4,541,321), it's too big and it totally hides the person's face while playing the harmonica creating a bad stage presence. The plastic clamp wears out loosing its holding strength. Similar problems with Hubbard's U.S. Pat. No. (4,212,219), this harmonica holder goes back to the spring clamp method with a wind screen that has too many parts that can fail. Strand U.S. Pat. No. (4,545,277) is still using a clamp but bolts and nuts secure the clamp and the microphone is inside his device which only allows one type of microphone used for amplification. Other types of microphones that many players prefer to use wouldn't even fit in to this invention.

Objects And Advantages

The JRT Harmonica Holder addresses all the problems of the past and is able to play a harmonica and another musical instrument at the same time. First it's a small device, aesthetically perfect for stage performance. Second, it is clean looking with no rusty springs, screws, bolts, plates or rubber parts to look at. There are no moving parts to wear out except stainless set screws. There is no metal to electrically shock a person. It is adaptable to many different types of microphones and easy to clean from human saliva. It is easy to work with for the guitar player, singer, and harmonica player.

BRIEF SUMMARY OF THE INVENTION

The JRT Harmonica Holder is a tool for the hand held harmonica particularly the ten hole harmonica. The JRT Harmonica eliminates the use of hands enabling a person to play more than one musical instrument simultaneously. The only harmonica holder on the market is made of metal and wire and operates with a spring loaded latch that mounts around a person's neck.

The JRT Harmonica Holder is a hollow tube that simulates the human hand cupped around the harmonica which is the original method used to play the harmonica. The tube is made of (PVC-Polyvinyl Chloride). The tube is slotted in a wedge pattern that traps the harmonica in a motionless position that allows for easy playing ability. The JRT Harmonica Holder mounts on a typical microphone stand. The microphone stand pedestal is bolted to a floor plate for stability and made for easy disassembly. One of the advantages is that the tube is made of PVC which is a product that has been approved for the use of water supply for human consumption and because of this fact the human mouth may contact, with the JRT Harmonica Holder. PVC has a smooth composition so bacteria is not prevalent and the tube can be washed and sanitized as easily as any dishware.

A main advantage of the JRT Harmonica Holder has to do with electrical shock which can cause harm, pain, and even death in the right circumstances. This problem arises when the harmonica player attempts to amplify the sound and his wet lips are touching on the metal made instrument and touching the microphone (that works by electricity) causing an electrical shock. This problem is currently happening in the music world. The PVC harmonica holder is a non-conductive and electrical shock is totally eliminated.

DETAILED DESCRIPTION OF INVENTION

List of Reference Numbers

10 Tubular Harmonica Holder
12 Sound Horn
13 Tubular Elbow slip to thread
14 Harmonica Holder Extension Arm
15 PVC ¾"×½"×½" Tee with threaded hole for ¼" lock screw
16 Microphone Holding Arm
17 Microphone Swivel Holder
18 Vertical ½" Microphone Stand Shaft
19 Vertical ¾" Microphone Stand Shaft
20 Microphone Stand Pedestal
21 Pedestal Bolts for Support Plate
23 Harmonica
24 Harmonica Holder ¾" Extension Shaft
25 Microphone
26 Harmonica Holder Adjustment Screw
27 Triangular Support Bar

28 Triangular Support Bar Fastening Screw
29 Tee Adjustment Screw
30 Microphone Stand Pedestal Winged Acorn Nut
31 ½" Male Adapter
32 Sound Horn Adjustment Screw

DESCRIPTION OF THE PREFERRED EMBODIMENT

Figure 1:
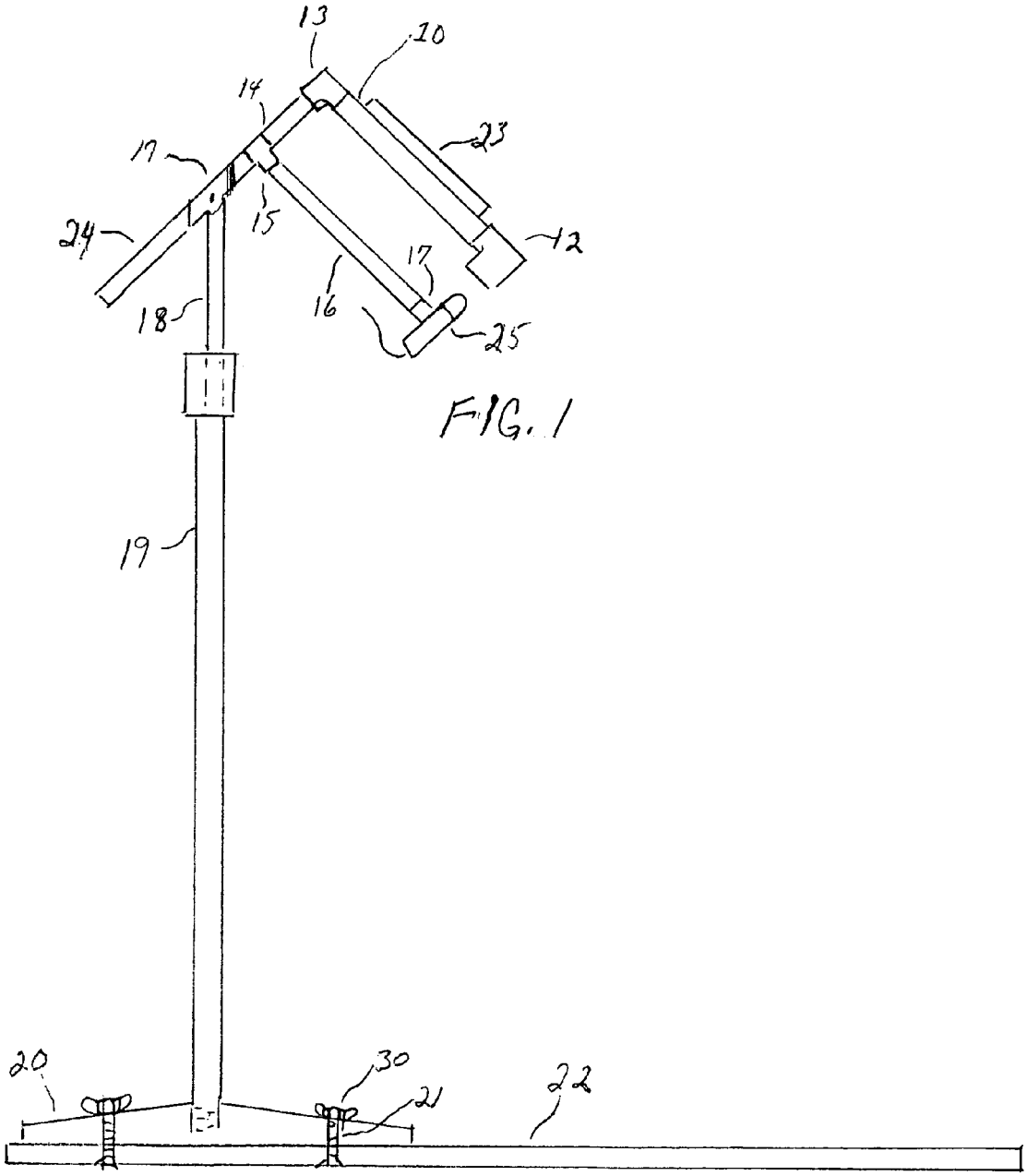
FIG. 1 is an all over view of the harmonica holder, stand and support plate.

FIG. 1 is an overview of the complete assembly of the JRT Harmonica Holder and Stand. This view depicts the usual position the harmonica holder (10) and the harmonica (23) is positioned for a person to play the harmonica (23). The sound horn (12) and the microphone (25) shows a distance between them, which is adjustable for reasons of interchanging microphones, assembly and disassembly and bringing the sound horn (12) and the microphone (25) closer together for better amplification. In order to do this, an adjustment has been designed by way of sliding the harmonica holder extension arm (14) which is a ½" pvc pipe into the ¾" pvc tee (15) and locking the adjustment down by wing nut (29).

The harmonica holder's ¾" extension shaft (24) is another necessary adjustment, allowing the performer to stand or sit closer or further from the microphone stand shaft (19) and the microphone stand pedestal (20). The ¾" harmonica holder extension shaft (24) is slid into position through the microphone swivel holder (17) which is attached to the vertical ½" microphone shaft by way of a common thread size for microphone swivel holders.

Referring again to FIG. 1, the microphone stand pedestal (20) is attached to the microphone support plate (22) with pedestal bolts (21), the bolts are secured by stainless steel acorn winged nuts (30). The bolts (21) enter through the under side of the support plate (22) through pre-drilled holes and enter through the under side of the microphone stand pedestal (20) through pre-drilled holes.

Figure 2:
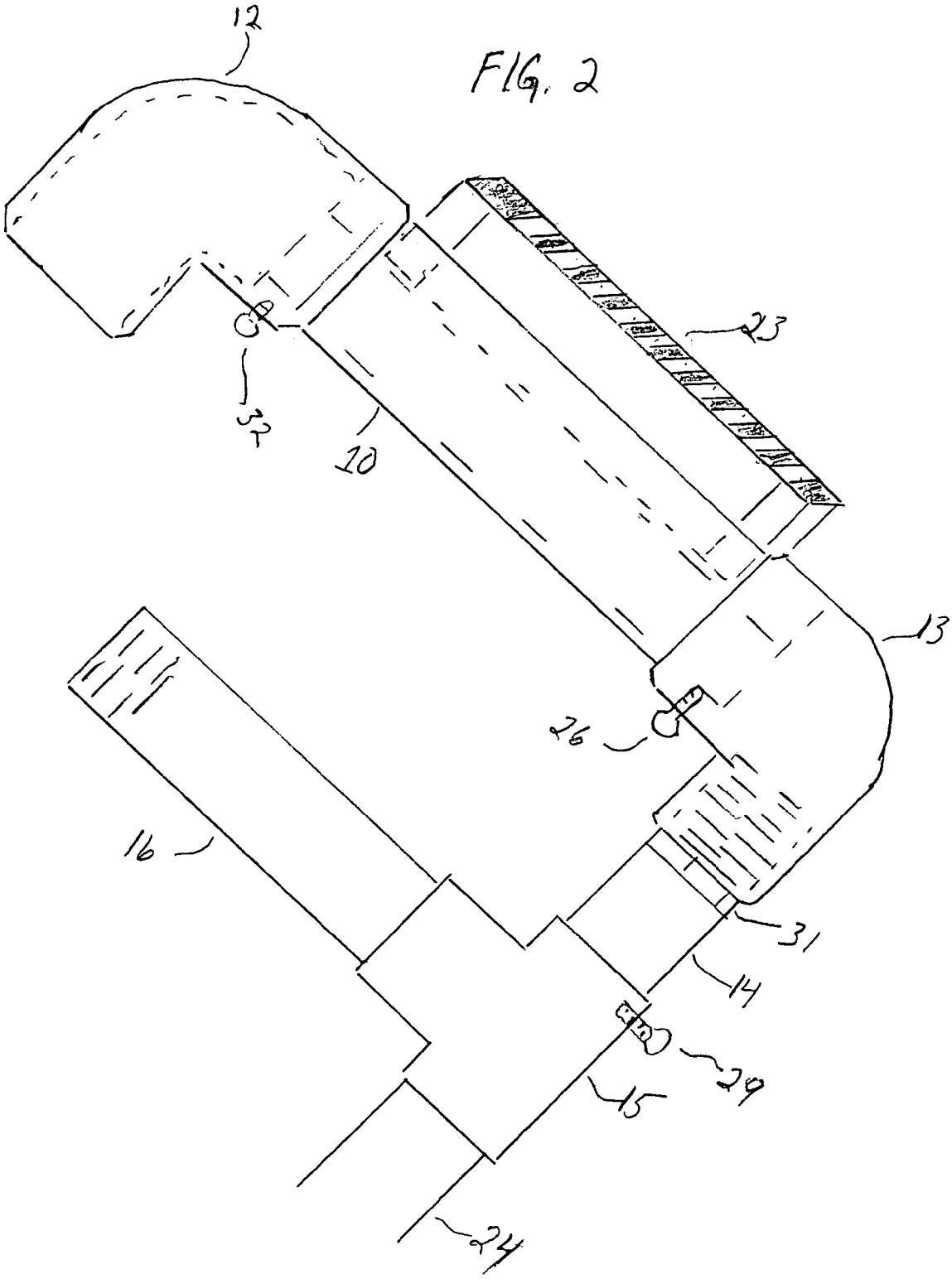
FIG. 2 is a perspective view of the harmonica holder.

FIG. 2 is a perspective view of the harmonica holder (10) showing a close up view of the relationship between the harmonica holder (10) and the harmonica (23) and how the harmonica (23) sits in the actual holder (10). In order for the harmonica to be placed into the harmonica holder (10), the sound horn (12) must slide off the harmonica holder (10) and then the harmonica (23) can be slid into the harmonica holder (10) through the tapered wedged slot. The harmonica (23) is locked in by the sound horn (12) by sliding the sound horn back on the harmonica holder (10) and then tightening the adjustment (32), the harmonica (23) is ready for playing. The tubular elbow (13) as shown is a slip to thread elbow, the threaded elbow allows an up and down adjustment for easy playing ability and a connection for a cpvc ¾" to ½" reducing male adapter (31). The male adapter (31) is permanently glued to extension arm (14). The tubular elbow (13) has one more adjustment on the slip side of the elbow. Adjustment screw (26) allows the harmonica holder (10) to turn for easy playing ability.

The microphone arm (16) is also shown in FIG. 2 with a typical threaded end for a typical microphone swivel holder (17). The swivel holder (17) and the microphone (25) are shown in position on FIG. 1.

Figure 3:
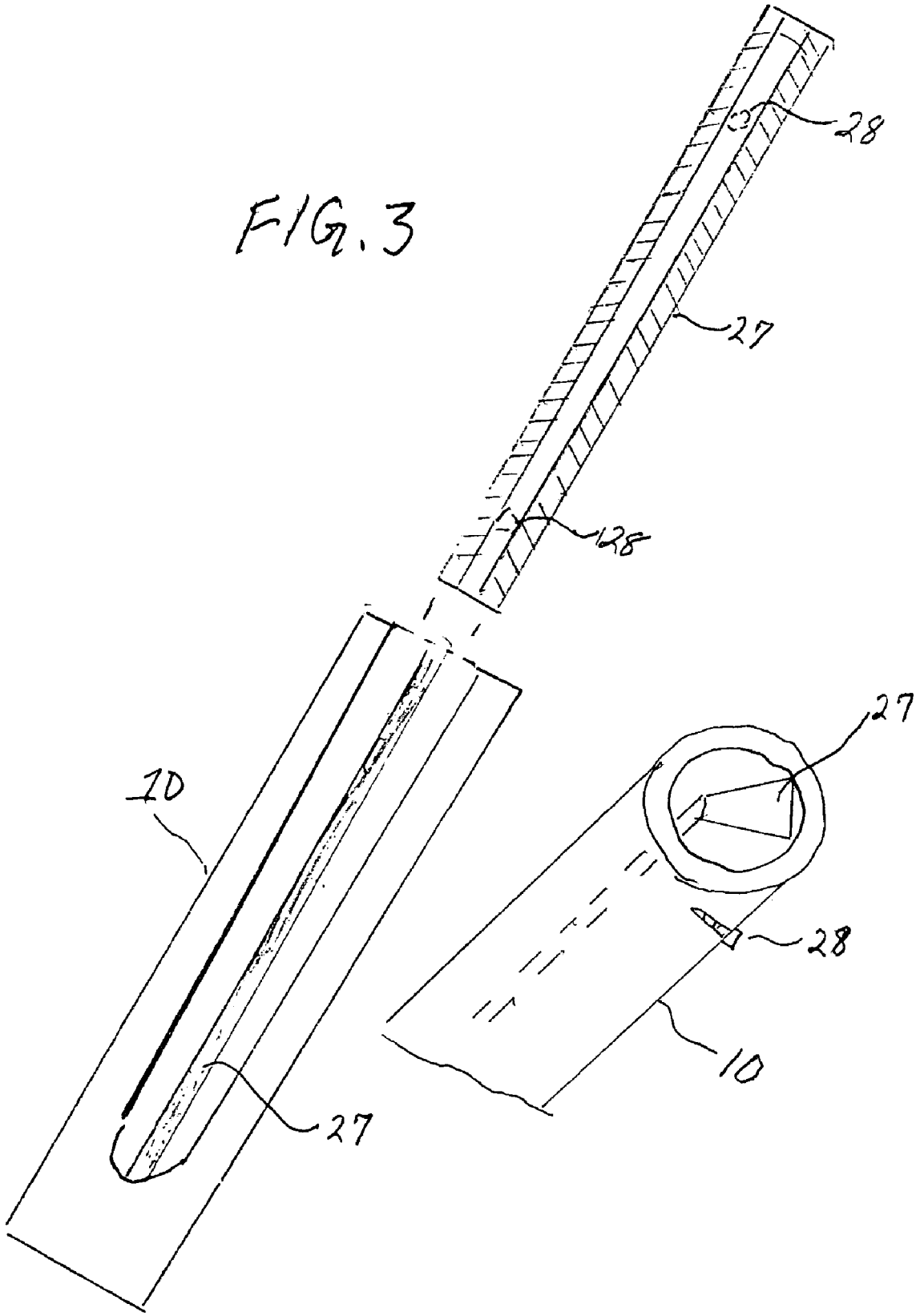
FIG. 3 is an exploded view of the tapered slotted tube and support.

FIG. 3 shows the harmonica holder (10) with a tapered wedged slot and the triangular support bar (27) sitting in the bottom of the tube plus a view of the support bar itself and then again showing the support bar (27) in an end view sitting in the harmonica holder (10). Also shown is the method used to fasten the support bar (27) to the harmonica holder (10) using two self tapping aluminum screws. The support bar (27) can be made out of many different materials like hard plastic, wood or neoprene.

The support bar (27) does just what it is titled, it gives support to the bottom side of the harmonica during insertion of the harmonica (23) and after the harmonica has reached its designed stable position ready for playing.

What is claimed is:

1. A harmonica holder comprising a base; said base connected to a ¾ inch chlorinated polyvinyl chlorine pipe connected to a ¾ inch ×½ inch ×½ inch chlorinated polyvinyl chlorine reducing tee, a ½ inch chlorinated polyvinyl chlorine pipe being inserted into said ½ inch ×½ inch ×¾ inch reducing tee; said reducing tee providing extension adjustments, a ½ inch chlorinated polyvinyl chlorine male adapter connected to said ½ inch chlorinated polyvinyl chlorine pipe; said ½ inch chlorinated polyvinyl chlorine male adapter connected to a ½ inch ×1 inch polyvinyl chlorine elbow slip to thread; said elbow connected to a 1 inch polyvinyl chlorine pipe; said 1 inch pipe having an elongated slot that holds a harmonica; and said polyvinyl-chlorine 1 inch pipe comprising a triangular support bar attached perpendicular to said elongated slot; said polyvinyl chlorine elbow comprising set screws for locking said harmonica.

2. The harmonica holder of claim one further comprising said ½ inch chlorinated poly vinyl chlorine pipe with first end being threaded and second end being attached on a 90 degree angle to said ½×½×¾ inch chlorinated polyvinyl chlorine reducing tee.

3. The harmonica holder of claim 1 further comprising a platform attached to the bottom of a microphone stand pedestal for stability.

* * * * *